US011542713B2

(12) United States Patent
Doupe

(10) Patent No.: US 11,542,713 B2
(45) Date of Patent: Jan. 3, 2023

(54) DECKING

(71) Applicant: Klevaklip Systems Pty Ltd, Cromer (AU)

(72) Inventor: Greg James Doupe, Sydney (AU)

(73) Assignee: Klevaklip Systems Pty Ltd, Cromer (AU)

( * ) Notice: Subject to any disclaimer, the term of this patent is extended or adjusted under 35 U.S.C. 154(b) by 0 days.

(21) Appl. No.: 17/000,166

(22) Filed: Aug. 21, 2020

(65) Prior Publication Data

US 2021/0054633 A1 Feb. 25, 2021

(30) Foreign Application Priority Data

Aug. 23, 2019 (AU) ..... 2019903092

(51) Int. Cl.
*E04F 15/02* (2006.01)
*E01C 5/00* (2006.01)

(52) U.S. Cl.
CPC ..... *E04F 15/02044* (2013.01); *E01C 5/006* (2013.01); *E04F 15/02183* (2013.01); *E04F 2015/02055* (2013.01); *E04F 2015/02094* (2013.01); *E04F 2015/02116* (2013.01)

(58) Field of Classification Search
CPC ..... E04F 15/02044; E04F 15/02183; E04F 2015/02116; E04F 2015/02055; E04F 2015/02094; E01C 5/006; E04B 2002/7496
See application file for complete search history.

(56) References Cited

U.S. PATENT DOCUMENTS 8,136,308 B2 * 3/2012 Slott ..... E04F 15/02044 52/126.1

FOREIGN PATENT DOCUMENTS

| | | | | |
|---|---|---|---|---|
| DE | 202013105584 U1 * | 1/2014 | ..... | E04F 15/02044 |
| DE | 102014115272 A1 * | 4/2016 | ..... | E04F 15/02044 |
| DE | 202016002718 U1 * | 6/2016 | ..... | E04F 15/02183 |
| KR | 20110024247 A * | 3/2011 | | |
| KR | 20140001630 A * | 1/2014 | ..... | E04F 15/02044 |
| KR | 101360874 B1 * | 2/2014 | | |

* cited by examiner

*Primary Examiner* — Theodore V Adamos
(74) *Attorney, Agent, or Firm* — Cahn & Samuels, LLP

(57) ABSTRACT

A joist support and joist assembly for use in a decking structure, the joist support and joist being adapted to be fitted together in an assembled position, the joist support including a support body which includes a base wall having a bottom side and a top side, two spaced apart side walls extending from the base wall away from the top side thereof so as to provide a channel having an open top and opposed spaced apart open ends, the channel when in use being configured so as to at least partially receive a joist therein such that an outer side of a bottom wall of the joist lies adjacent the top side of the base wall of the joist support.

15 Claims, 11 Drawing Sheets

DECKING

TECHNICAL FIELD

This disclosure relates to decking structures or systems for decks or decking, and components therefor. More particularly, although not exclusively, the disclosure relates to decking structures or systems for decking suitable for patios and the like, and also, to methods of installation.

BACKGROUND ART

Decks come in many shapes and sizes. Some decks are high off the ground, and some decks are low to the ground. Some decks are attached to houses and some decks are freestanding. Some decks are built for large public areas, whilst many are located in private areas of an individual's property. In light of the many applications, there are many known methods for building a deck.

Typically, decking structures or systems for use in decks or decking are constructed using a combination of posts, bearers and joists. However, in some instances, for example, when decking is being constructed above a concrete slab or in patio or balcony areas, there is little or no room for traditional posts, bearers, and/or conventional joists. In such instances, a builder or installer must work with the available space. This may result in less than desirable building practices, particularly where timber is laid directly onto concrete. One problem associated with laying timber directly onto concrete is that there is no room for moisture to escape, thus moisture may be absorbed by the timber which, in turn, causes premature decomposition of the timber.

SUMMARY OF DISCLOSURE

In one aspect, embodiments are disclosed of a joist support suitable for use with a joist in a decking structure, the decking structure overlying an undersurface when installed, the joist support comprising a support body which includes a base wall having a bottom side and a top side, two spaced apart side walls extending from the base wall away from the top side thereof so as to provide a channel having an open top and opposed spaced apart open ends, the channel when in use being configured so as to at least partially receive a joist therein.

In certain embodiments, when in the installed position, the bottom side of the base wall is disposed adjacent the undersurface. In certain embodiments, the bottom side of the base wall includes a substantially planar surface. The undersurface may be comprised by the ground, a concrete slab, a tiled area or the like. In one mode of installation the bottom side of the base wall of the joist support can be seated directly on the undersurface. In certain embodiments, the planar surface is the most remote or outer part of the support; that is there is no part of the support extending below the planar surface.

In certain embodiments, the joist support includes a support mounting formation adapted to cooperate with a joist mounting formation on the joist for securing the joist and the joist support in an assembled position. In certain embodiments, the cooperating mounting formations provide for a snap fit type connection for securing the joist to the joist support in the assembled position. In certain embodiments, the support mounting formation comprises two substantially resilient deformable flange members each extending inwardly from a respective side wall towards the base wall and terminating at a free end.

In certain embodiments, the joist support includes an aperture in the base wall for receiving a fastener for securing the joist support to the undersurface.

In another aspect embodiments are disclosed of a joist support and joist assembly for use in a decking structure, the joist support and joist being adapted to be fitted together in an assembled position, the joist support being as described above, the joist comprising an elongated body having opposed spaced apart ends, a top wall, a bottom wall spaced from the top wall and spaced apart side walls extending between the top and bottom walls, the bottom wall having an outer side, the joist being at least partially received within the channel when in the assembled position with the outer side of the bottom wall of the joist being adjacent or abutting the top side of the base wall of the joist support.

In certain embodiments, the joist includes a recess in the outer side of the bottom wall and the joist support includes an aperture referred to earlier extending through the base wall, the recess overlying the aperture when in the assembled position.

In certain embodiments, the joist comprises a joist mounting formation which is adapted to cooperate with the support mounting formation so as to secure the joist to the support when in the assembled position. In certain embodiments, the joist mounting formation comprises shoulders on respective side walls of the elongated body, the free ends of the flange members engaging against the shoulders when in the assembled position. In certain embodiments, the sidewalls each include a recess therein, each recess having a lower edge which provides for the shoulder.

In yet another aspect, embodiments are disclosed of a height adjuster for use with a joist support, the height adjuster comprising a base part and a carriage, the base part including an inclined ramp section providing a pathway along which the carriage can travel in a lengthwise direction, and an interlock arrangement for enabling the carriage to be held in any one of a number of positions along the ramp section.

In certain embodiments, the base part includes a base body having a bottom, and a top which has the ramp section thereon and which is inclined with respect to the bottom, the carriage including a carriage body having an underside which, in use is disposed adjacent the ramp section and an upper joist support mounting section. In certain embodiments, the underside is inclined relative to the bottom so that the mounting section maintains the joist support in a substantially level orientation when mounted thereto.

In certain embodiments, the interlock arrangement comprises a plurality of spaced apart ramp formations on the ramp section and one or more cooperating carriage formations on the carriage which are configured to hold the carriage in a selected position on the ramp section. In certain embodiments, the ramp formations comprise a plurality of spaced apart elongated ribs which extend laterally with respect to the lengthwise direction from one side of the ramp section to the other side and along the length thereof, and one or more ribs on the underside of the carriage body which are arranged to be able to interfit with the ramp ribs so as to inhibit movement of the carriage along the ramp section when in an interfitted position.

In certain embodiments, the height adjuster further includes a tracking guide arrangement for guiding the movement of the carriage along the ramp section. In certain embodiments, the tracking guide arrangement comprises a cooperating flange and slot on the base part and carriage, one of either the flange or slot being on the base part and extending in the lengthwise direction, the other being on the carriage, the flange being received within the slot so as to guide the movement of the carriage along the ramp section.

In certain embodiments, the height adjuster further includes a connector for releasably connecting the joist support to the carriage. In certain embodiments, the connector comprises a post comprising a plurality of deformable segments having free ends which together form a post head, the post being receivable in an aperture in the joist support to provide for a snap fit type connection.

In certain embodiments, the height adjuster is suitable for use with a joist support as described above.

In yet another aspect, embodiments are disclosed of a decking structure comprising a plurality of joist supports and joist assemblies positioned in an array over an undersurface, the assemblies being as described above.

In certain embodiments, a plurality of joist supports are arranged in spaced apart relation along each of the joists. In certain embodiments, at least some of the joist supports are secured to the undersurface in one mode of installation. In certain embodiments, at least some of the joist supports are mounted to height adjusters as described above in another mode of installation.

In yet another aspect, embodiments are disclosed of a decking system or structure for mounting multiple decking panels, the decking system or structure including multiple decking or joist supports for securing relative to an undersurface, and multiple decking joists, each decking joist being mounted relative to the undersurface using at least a pair of the multiple decking or joist supports.

In certain embodiments, as mentioned earlier the surface may be in the form of a surface of a concrete slab, and more particularly, an upper surface of the concrete slab. The surface may comprise a flat generally horizontal surface located underneath the deck formed from the structure and associated decking panels. In certain embodiments, the decking or joist supports are mounted to the upper surface of the concrete slab.

In certain embodiments, multiple decking or joist supports may be secured to a surface for mounting the decking joists. In turn, decking panels may be mounted to the joists to form a deck. Advantageously, this removes the need for the traditional posts, bearings and joists formation which require a larger space once assembled which is undesirable in situations where space is limited or even not available. In other words, the multiple decking or joist supports in one mode of installation enable a patio deck to be built very low to the surface, e.g. over a concrete slab or tiled area.

Each decking or joist support may be formed of any suitable material known in the art. In certain embodiments, each decking support will be made from a plastics material.

Each decking or joist support may be formed of a single piece. Each decking support may be substantially U-shaped. Each decking or joist support may be integrally formed.

In certain embodiments, each decking or joist support may include a body. The body may include a lower portion including base. The base may include a base wall.

The base wall may be of any suitable thickness. However, a skilled person would understand that the thicker the base wall, the more space the decking structure or system will ultimately require. In certain embodiments, the base wall will be planar or substantially planar. In certain embodiments, the base wall may have a constant thickness. However, a skilled person would understand that in some embodiments, the base wall may have a varied thickness.

In certain embodiments, the base may include a lower abutment surface for abutting a surface to which the support is mounted, typically, a patio or concrete surface. In certain embodiments, the abutment surface is planar, or substantially planar. In certain embodiments, the abutment surface may include a textured or rough surface. Typically, the abutment surface may form part of the base wall. In certain embodiments, the lower abutment surface defines the lower most surface of each decking support.

The base may further include at least one aperture. The aperture may be defined by the base wall. The aperture may extend wholly thorough the base wall. In certain embodiments, a fastener may be received within the aperture in order to fasten the decking or joist support to a surface. In certain embodiments, the aperture may be centrally, or substantially centrally, located on the base wall.

The body of the decking or joist support may further include a pair of arms. Each of the pair of arms may be in the form of an upwardly extending arm. In certain embodiments, the pair of upwardly extending arms may be spaced apart by the base wall of the decking support. Typically, the upwardly extending arms may extend away from the lower abutment surface of the base. In certain embodiments, each of the pair of arms may extend perpendicular or substantially perpendicular to the basewall.

Together the base and the pair of arms may define a channel for receiving at least a portion of a decking joist.

Each of the pair of arms may include an inwardly extending member. Each inwardly extending member may extend towards a centre of the channel. Each inwardly extending member may be resiliently deformable. Each member may extend from an upper end of each respective arm inwardly and downwardly, towards the base. Typically, each inwardly extending member may include an abutment surface or edge for abutting a respective shoulder of a decking joist. Each decking or joist support may include a mounting formation. The mounting formation may include the pair of inwardly extending members.

During mounting of a decking joist to at least one decking or joist support, the inwardly extending members of each decking or joist support may flex outwardly to allow passage of at least a portion of the respective joist to enter the channel of the decking or joist support and then flex back inwardly once the respective joist is received within the channel such that the arms of the decking or joist support inhibit removal of the respective joist from the channel.

Each decking support may be said to be in the form of a base clip or joist clip.

The decking system or structure may include multiple elongate members which may be in the form of joists. Each elongate member may be any suitable length to suit the application. Typically, each elongate member may have a substantially rectangular or square cross sectional area. Preferably, each elongate member may be in the form of an extrusion. In certain embodiments, each elongate member may be in the form of a hollow extrusion. The ends of the extrusion may be open ends.

Each elongate member may be any suitable height or width to suit the specific application. Typically, the height of each elongate member will be between 30 mm and 90 mm. Advantageously, the lower the height of the elongate members, the lower the resulting decking will be off the surface. Typically, all of the elongate members in the system will have the same cross sectional area dimensions. However, in some embodiments, the lengths of the elongate members in the system may vary.

The elongate members may be made of any suitable material known in the art to support decking panels. Typically, each elongate member may be formed of an extruded metal, such as aluminium.

In certain embodiments, each elongate member may include a body. The body may include a pair of side walls, a top wall and a base wall. The body may further include a lower portion for being at least partially received within the channels defined by one or more decking supports. The lower portion may include at least the base wall and at least a portion of each of the pair of side walls, particularly, a lower portion of each of the side walls.

Each elongate member may further include at least one side recess for receiving at least a portion of a decking support. Typically, each elongate member will include a pair of side recesses. Each side recess may be substantially elongate and extend the length of the decking joist. Each side recess may form part of a respective side wall of the body.

Each elongate member may include at least one shoulder for abutting at least a portion of a decking support. In some embodiments, each elongate member may include a pair of shoulders. Each shoulder may be substantially elongate and extend the length of the decking joist. Typically, each shoulder may abut at least a portion of multiple decking supports. In certain embodiments, a portion of each of the shoulders of the pair of shoulders may abut a respective abutment surface or edge of one or more decking or joist supports.

Each elongate member may include a decking or joist support abutment surface for abutting at least a portion of one or more decking supports. In some embodiments, each elongate member may include a pair of decking or joist support abutment surfaces. Each decking abutment surface may form part of one of the pair of shoulders.

Each elongate member may include another recessed channel. The at least one other recessed channel may extend along a lower portion of the joist. In most preferred embodiments, the at least one other recess channel forms part of the base wall of each elongate member. The at least one other recess channel may extend the length of each elongate member. Advantageously, the at least one other recess channel creates a space for housing a protruding head of a fastener used to secure a decking support to the surface.

Each elongate member may include at least one locating surface for locating the joist relative to each decking or joist support. In some embodiments, the decking joist may include a pair of locating surfaces. In most embodiments, each locating surface abuts at least a portion of the decking or joist support. In certain embodiments, each locating surface abuts an inner surface of the base wall and/or an inner surface of each arm of the decking or joist support. Typically, each locating surface is substantially planar and extends the length of the respective elongate member.

Each elongate member may further include at least one decking panel abutment surface. Typically, the decking panel abutment surface may be the upper most surface of each elongate member. Typically, the decking panel abutment surface will be planar or substantially planar. Typically, the decking panel abutment surface may be substantially elongate.

Each elongate member may further include a mounting formation corresponding to the mounting formation of the decking supports. Each elongate member mounting formation may include at least the pair of shoulders. Each elongate member mounting formation may further include at least the decking support abutment surfaces.

As mentioned above, the decking includes multiple decking panels. Each decking panel may be any suitable decking panel known in the art. Each decking panel may include an abutment surface for abutting the decking panel abutment surface of one or more for of the multiple elongate members or joists. Each decking panel may be mounted to one or more of the elongate members or joists using any suitable mounting means know in the art, such as using one or more fasteners, adhesives or a combination thereof.

In yet another aspect, embodiments are disclosed of a base clip or joist clip for mounting a decking joist including a mounting formation, the base clip or joist clip including: a mounting formation corresponding to the decking joist mounting formation, the mounting formation of the base clip or joist clip being at least partially received within the mounting formation of the decking joist.

In yet another aspect, embodiments are disclosed of a decking joist for mounting to a base clip or joist clip including a mounting formation, the decking joist including: a mounting formation corresponding to the mounting formation of the base clip or joist clip, at least a portion of the mounting formation of the decking joist for being received within a portion of the base clip or joist clip.

In yet another aspect, embodiments are disclosed of a deck or decking including: at least two pairs of decking or joist supports, in the form of base clips or joist clips, at least two decking joists, and multiple decking panels for mounting to the at least two decking joists.

In yet another aspect, embodiments are disclosed of a method for installation of a deck or decking including multiple base clips or joist clips, multiple decking joists and multiple decking panels, the method including the steps of: securing the base clips or joist clips relative to a surface, mounting at least two decking joists, each to multiple base clips or joist clips, mounting the multiple decking panels to the at least two decking joists.

In certain embodiments, the step of securing the base clips or joist clips relative to a surface includes securing each base clip or joist clip to the surface using at least one fastener and/or adhesive.

In certain embodiments, the step of mounting at least two decking joists, each to multiple base clips or joist clips includes receiving at least a portion of each decking joist into a channel defined by each respective base clip or joist clip.

In certain embodiments, the arms of each base clip or joist clip flex outwardly to allow passage of at least a portion of the decking joist, such that the portion of the decking joist enters the respective channel of each respective base clip or joist clip during mounting. Typically, the arms of each base clip or joist clip subsequently flex inwardly once at least a portion of the decking joist enters the respective channel in order to prevent the decking joist from being dislodged from each respective base clip or joist clip channel.

BRIEF DESCRIPTION OF DRAWINGS

Notwithstanding any other forms which may fall within the scope of the method and apparatus set forth in the summary, specific embodiments of the method and apparatus will now be described by the way of example and with reference to the accompanying drawing in which.

DETAILED DESCRIPTION

Figure 16:
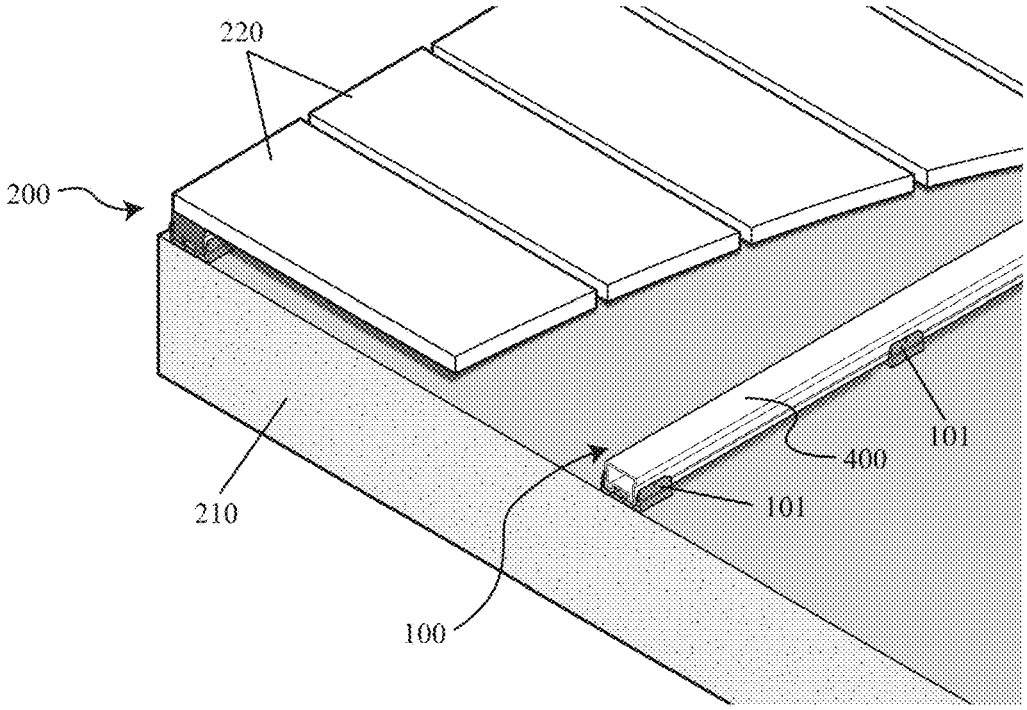
FIGS. 16 to 19 are schematic illustrations of decks incorporating decking structures according to various embodiments.
Figure 17:
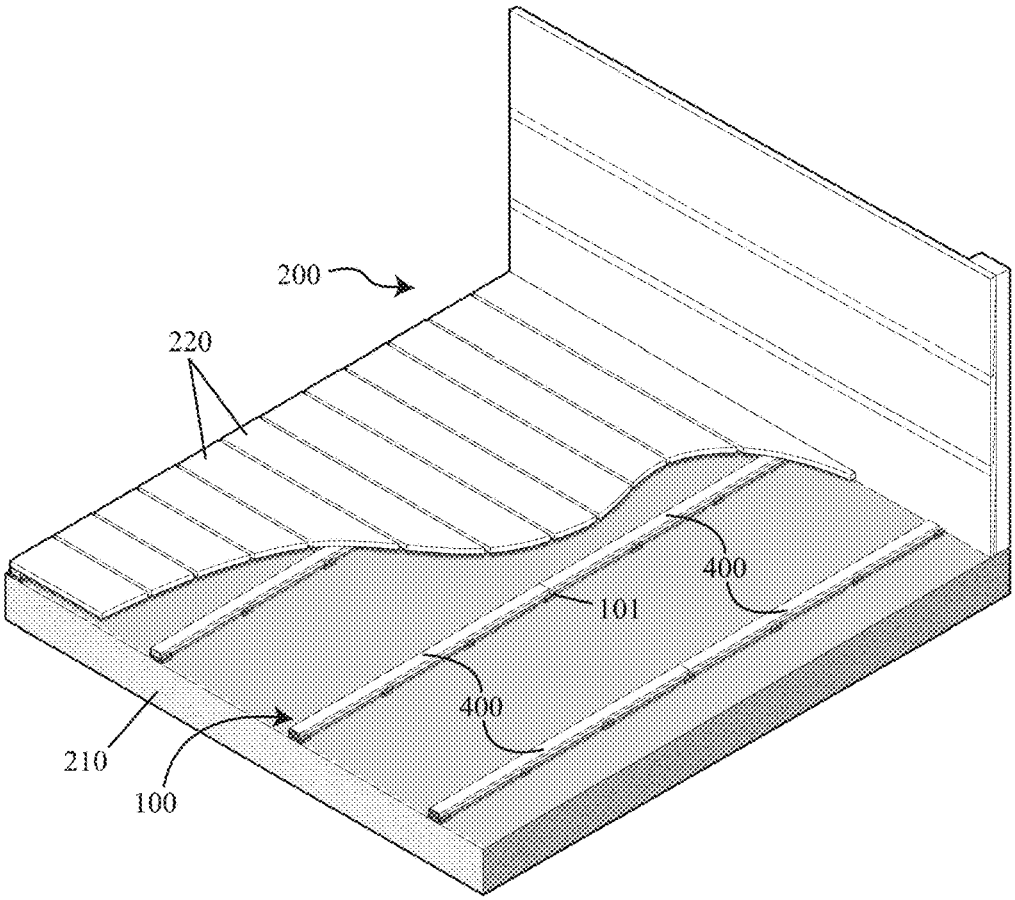
Figure 18:
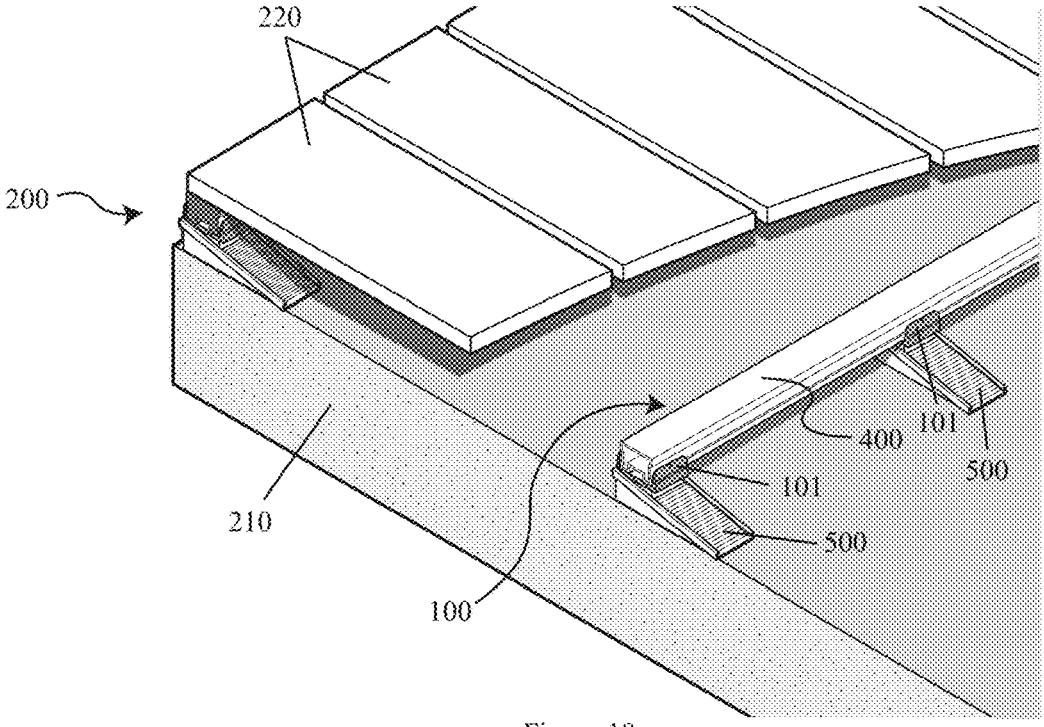
Figure 19:
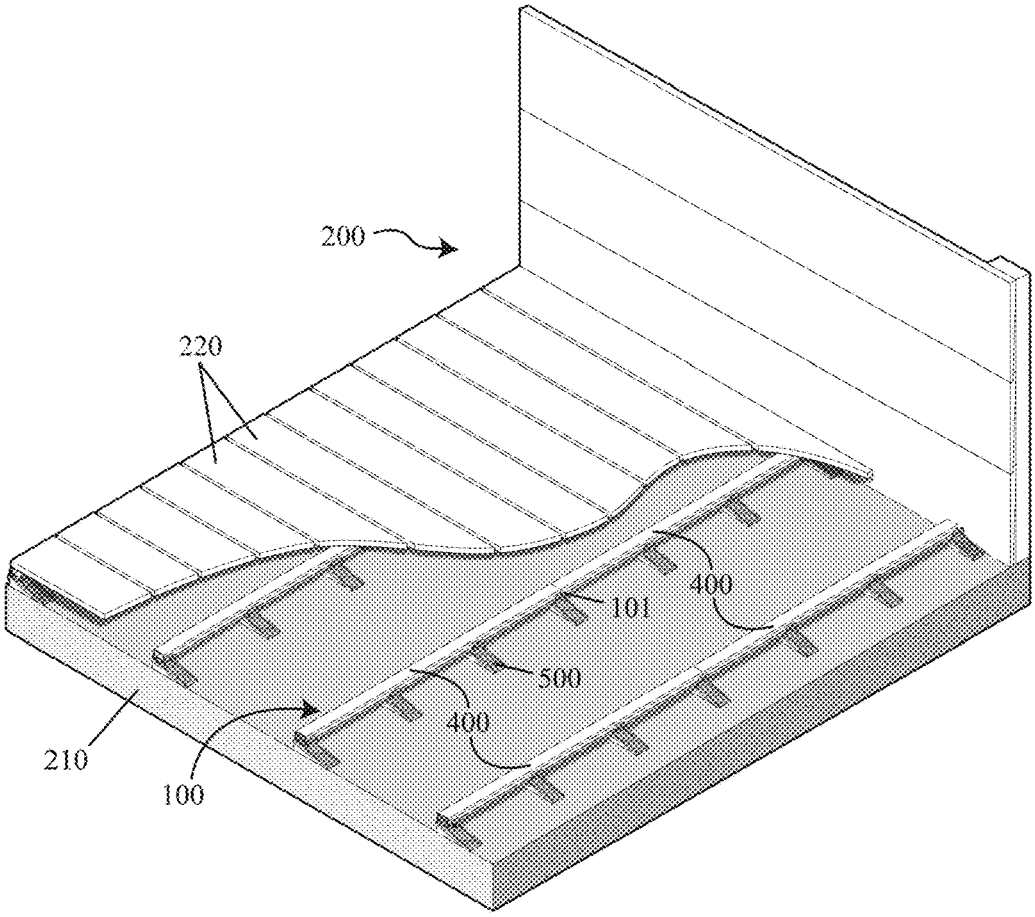

FIGS. 16 to 19 illustrate a deck or decking 200 which is shown partially cut away to show decking structures 100 of two types, one shown in FIGS. 16 and 17 and the other shown in FIGS. 18 and 19. The structures 100 are shown disposed upon an undersurface in the form of a concrete slab 210. The deck or decking includes a series of panels 220 mounted to the decking structure 100.

Figure 1:
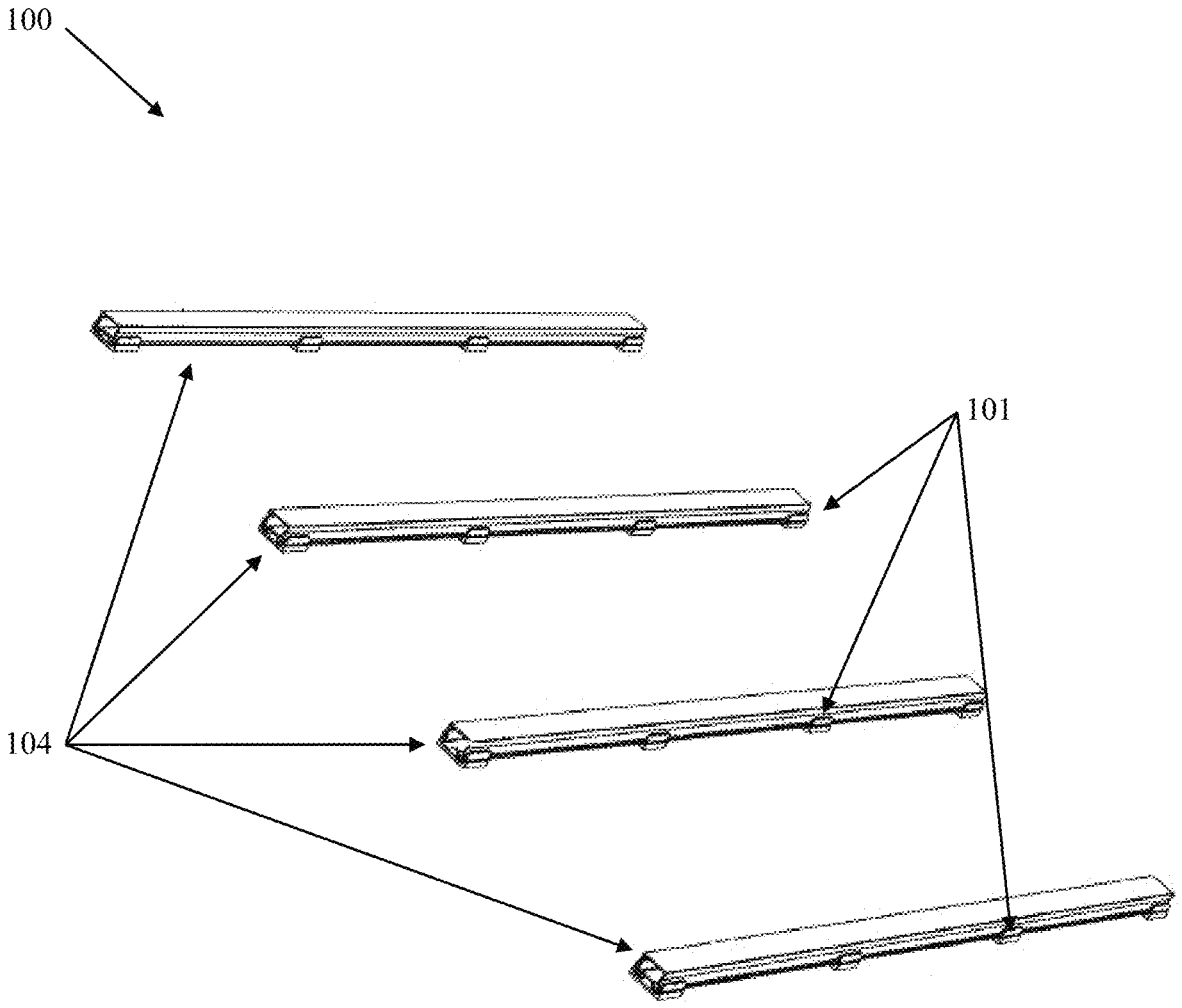
FIG. 1 shows an isometric view of a structure for mounting one or more decking panels in accordance with one embodiment.
Figure 2:
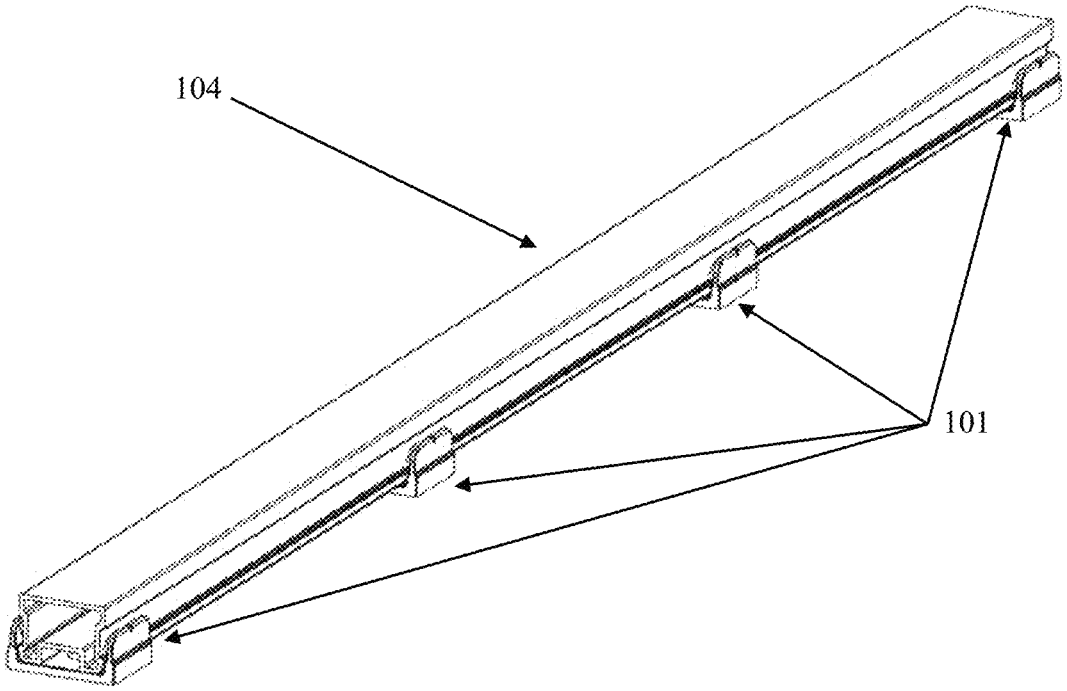
FIG. 2 shows an isometric view of a joist mounted to four joist supports or base or joist clips in accordance with the embodiment shown in FIG. 1.
Figure 2A:
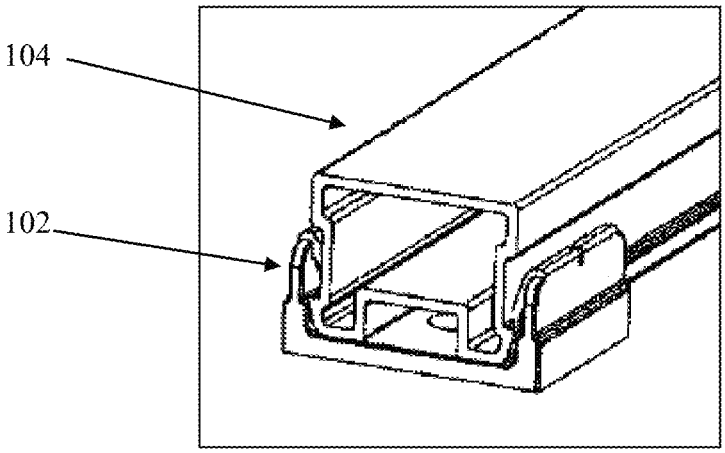
FIG. 2A shows a close up view of a portion of the joist attached to a base or joist support or clip shown in FIG. 2.

One embodiment of a decking structure or system 100, is shown in FIGS. 1 to 4A, in particular FIG. 1. The structure 100 includes multiple decking or joist supports 101. The joist supports 101 may be described as clips 102 (FIG. 2A). There are sixteen illustrated in FIG. 1. The structure 100 further includes multiple decking joists 104. In the example embodiment shown, four decking joists are illustrated. Each decking joist 104 is mountable relative to the undersurface 210 using four joist supports, base or joist clips 102. A skilled person would understand that other systems may include any number of decking joists depending on the size of the area being covered and any number of base or joist clips per decking joist depending on the length of the decking joists.

In certain embodiments, multiple joists base or joist clips may be secured to the undersurface for mounting the decking joists. In turn, decking panels may be mounted to the joists to form a deck or decking. Advantageously, this removes the need for the traditional posts, bearings and joists formation, which require a larger space once assembled, and is undesirable in situations where space is limited or even not available.

As mentioned above, system or structure 100 includes decking or joist supports 101. Each decking support 101 may be formed of any suitable material known in the art. In certain embodiments, the decking supports 101 will be made from a plastic/polymer material.

In certain embodiments, such as the one shown in the drawings, each decking or joist support 101 is formed of a single piece, is substantially U-shaped, and is integrally formed. This is best shown in FIGS. 3 and 3A.

Figure 3:
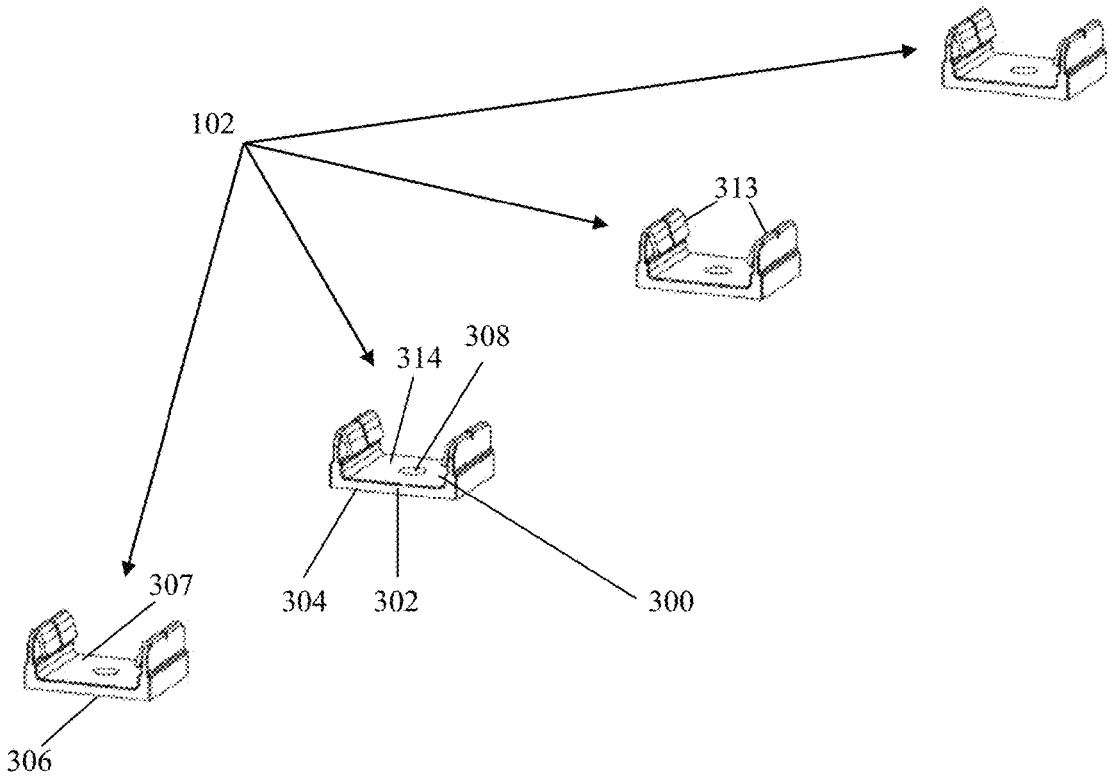
FIG. 3 shows four base or joist support or clips in accordance with the embodiment shown in FIG. 1.
Figure 3A:
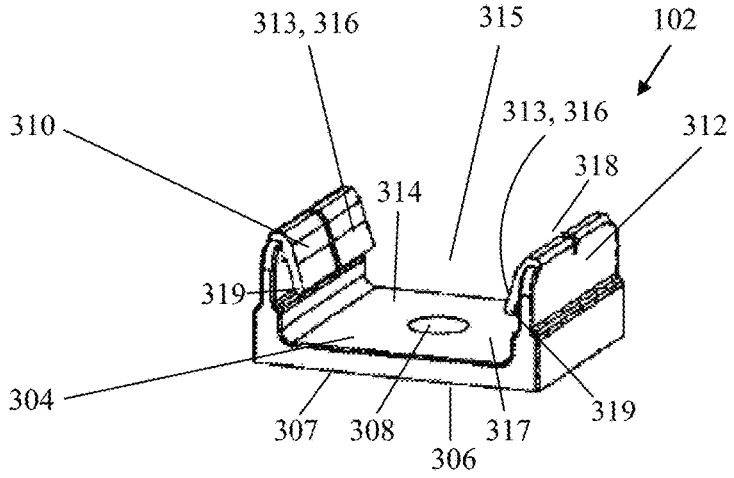
FIG. 3A shows a close up view of one of the base or joist supports or clips shown in FIG. 3.
Figure 4:
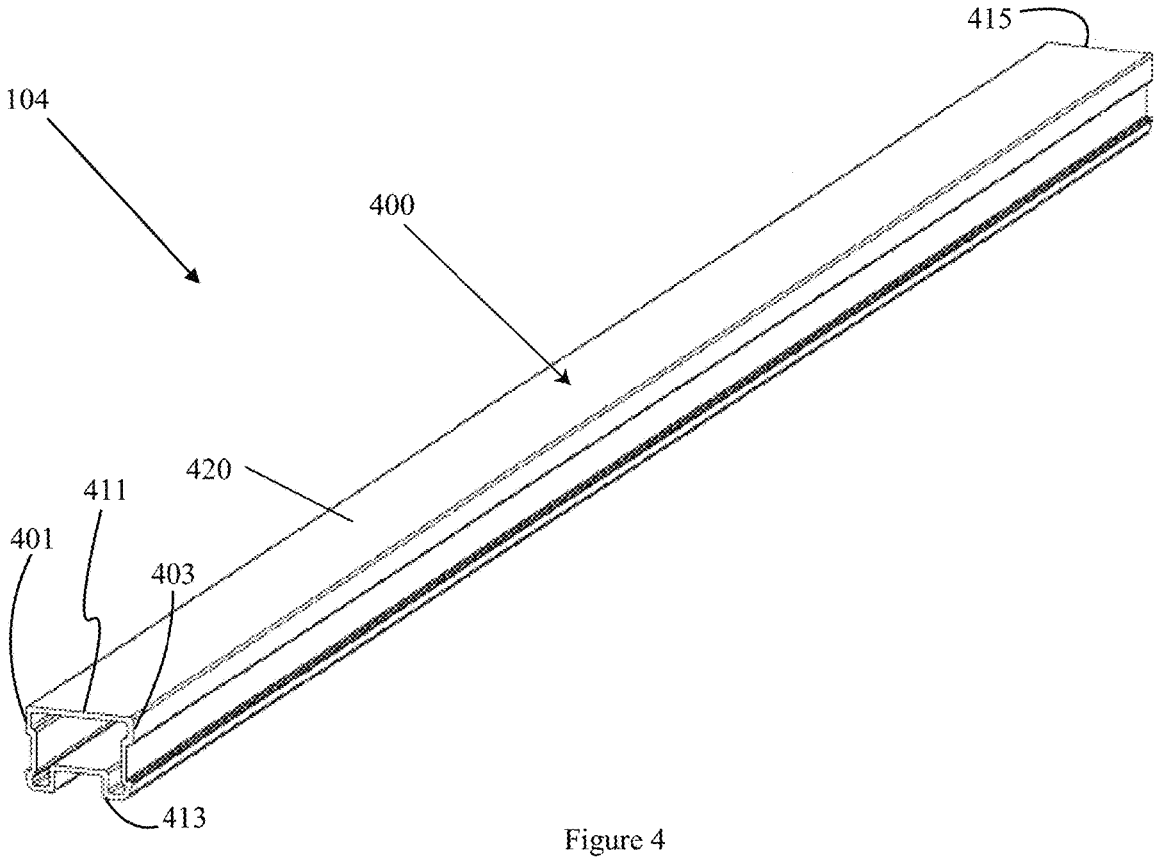
FIG. 4 shows a joist in accordance the embodiment shown in FIG. 1.
Figure 4A:
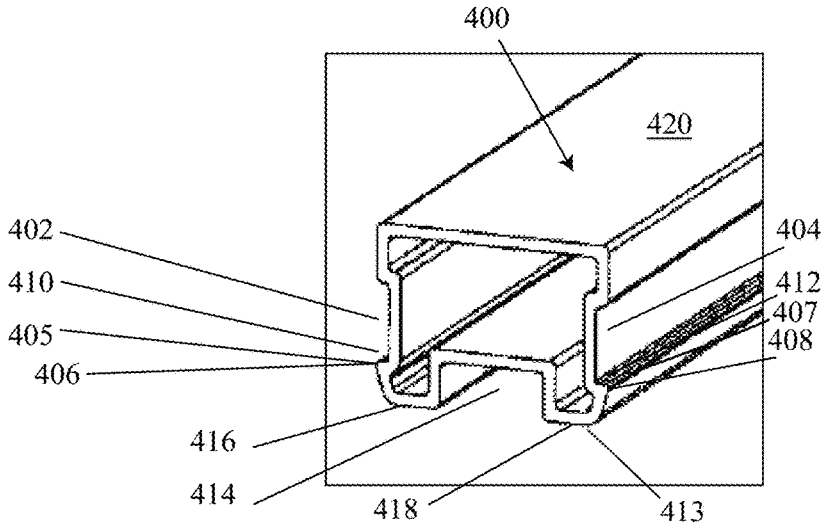
FIG. 4A shows a close up view of one end of the joist shown in FIG. 3.
Figure 5:
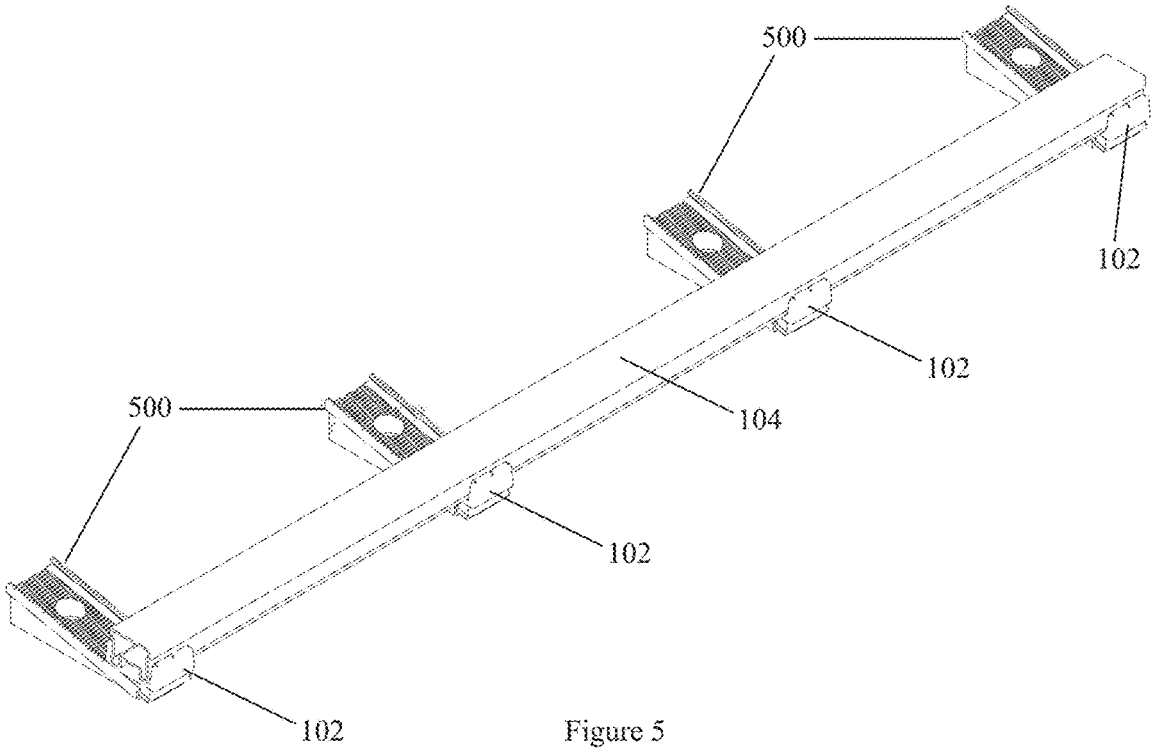
FIG. 5 is an isometric view of an assembly according to another embodiment.
Figure 6:
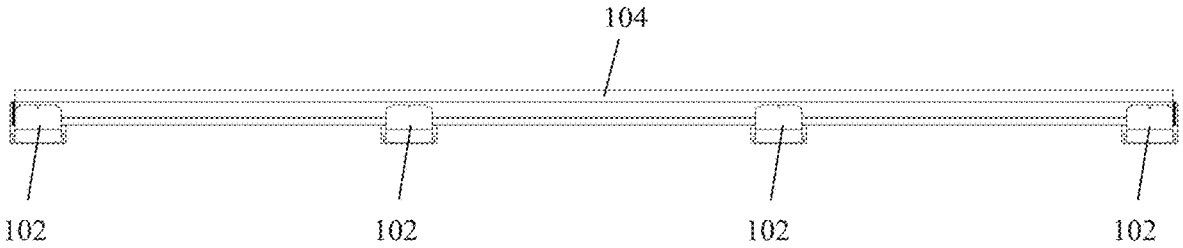
FIG. 6 is a side elevation of the assembly shown in FIG. 5.
Figure 7:
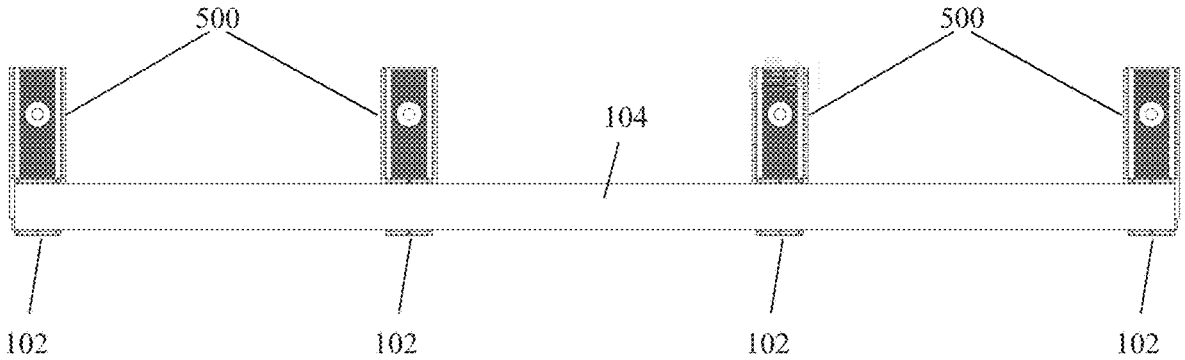
FIG. 7 is a plan view of the assembly shown in FIGS. 5 and 6.

In certain embodiments, each decking or joist support includes a body 300 (FIG. 3). Body 300 includes a lower portion which includes a base 302. The base 302 includes a base wall 304 having a top side 314 and a bottom side 307. In certain embodiments, base wall 304 is planar and has a constant thickness. This is best shown in FIGS. 3 and 3A.

Base 302 further includes a lower abutment surface 306 for abutting the undersurface 210 to which the support is mounted. In the certain embodiments, the abutment surface 306 is generally planar or at least corresponds to the shape of the surface 210 to which it is being mounted. As can be best seen in FIG. 3, each abutment surface 306 forms part of the respective base wall 304. Further, each lower abutment surface 306 defines the lower most surface or part of each decking/joist support 101.

Base 302 may further include an aperture 308 for receiving a fastener. Aperture 308 is defined by base wall 304. As can be best seen in FIG. 3, aperture 308 is centrally located through base wall 304 and extends wholly therethrough. In preferred embodiments, such as the one shown, a fastener may be received within aperture 308 in order to fasten the respective decking/joist support 102 to the undersurface.

Body 300 of each decking or joist support 101 further includes a pair of arms 310, 312, each in the form of an upwardly extending arm (best shown in FIG. 3A). The pair of upwardly extending arms are spaced apart by base wall 304. The upwardly extending arms 310, 312 extend away from lower abutment surface 306. Each of the pair of arms 310, 312 extends substantially perpendicular to respective base wall 304. Together the base 302 and the pair of arms 310, 312 define a channel 315 for receiving at least a portion of a decking joist 104 (as best shown in FIGS. 2 and 2A). The channel 315 has opposed open ends 317 and 318.

Each of the pair of arms may include a resiliently deformable inwardly extending flange member 316 which together forms a mounting formation 313. Each inwardly extending member 316 extends inwardly, towards a centre of channel 315. Each member 316 extends from an upper end of each respective arm 310, 312 inwardly and downwardly, towards the base 302 or base wall 304. Typically, each member 316 includes an abutment surface or free edge or end 319 for abutting a respective shoulder of a decking joist 104.

During mounting of a decking joist 104 to the respective decking support 102, the inwardly extending members 316 of each decking support may flex outwardly to allow passage of at least a portion of the respective joist to enter the channel of the decking support and then flex back inwardly once the respective joist is received within the channel such that the arms inhibit removal of the respective joist from the channel. This can be described as a snap fit type connection. Decking structure 100 further includes multiple elongate members in the form of, the multiple decking joists 104. Each decking joist 104 may be any suitable length to suit the application. Typically, each decking joist 104 has a substantially rectangular cross sectional area, as can be best seen in FIG. 4A. In certain embodiments, each decking joist 104 is in the form of an extrusion, specifically a hollow extrusion. Ends 411 and 415 of each extrusion are open ends.

Each decking joist 104 may be any suitable height or width to suit the specific application. In the certain embodiments, the height of the extrusion will be between 30 mm and 90 mm. Advantageously, the lower the height of the multiple decking joist, the lower the resulting decking will be to the surface. Typically, all of the decking joists in the one system will have the same cross sectional area dimensions. However, the lengths of the joists in the system may vary.

Each decking joist may be made of any suitable material known in the art to support decking panels. In preferred embodiments, each decking joist 104 will be formed of an extruded metal, such as aluminium.

In the embodiments shown, each decking joist 104 includes an elongated body 400 having opposed ends 411 and 415. Body 400 includes a top wall 420, bottom wall 413, side walls 401, 403 with a lower portion for being at least partially received within one or more channels defined by one or more decking supports 102.

Each decking joist 104 includes a pair of side recesses 402, 404, each side recess for receiving at least a portion of a decking/joist support. Each side recess 402, 404 is substantially elongate and extends the length of the decking joist.

Each decking joist further includes a pair of shoulders 406, 408 providing a joist mounting formation 405, 407 for abutting at least a portion of a decking/joist support. Each shoulder is substantially elongate and extends the length of the decking joist. Each shoulder 406, 408 abuts at least a portion of one or more decking/joist supports 102. In preferred embodiments, a portion of each of the shoulders of the pair of shoulders 406, 408 abuts a respective abutment surface or edge of one or more joist supports or clips 102.

Each decking joist 104 includes a pair of decking support abutment surfaces 410, 412 for abutting at least a portion of decking/joist supports 102. Each decking support abutment surface forms part of a respective shoulder 406, 408.

In certain embodiments, each decking joist 104 further includes another recessed channel 414. The other recessed channel 414 extends along a lower portion of the joist. The other recess channel 414 extends the length of the decking joist. Advantageously, the other recessed channel 414 creates a space for housing a protruding head of a fastener used to secure a decking support to the undersurface.

In certain embodiments, each decking joist also includes pair of locating surfaces 416, 418 for locating the joist 104 relative to each decking/joist support 102. Each locating surface 416, 418 abuts a portion of the decking support, specifically, an inner surface of the base wall and an inner surface of each arm of the decking/joist support as shown best in FIG. 2A. Each locating surface 416, 418 is substantially planar and extends the length of the decking joist 104.

In certain embodiments, each decking joist 104 further includes a decking panel abutment surface 420. The decking panel abutment surface 420 is the upper most surface of the decking joist. As shown, the decking panel abutment surface 420 is planar, or substantially planar, and substantially elongate.

Each decking joist includes a mounting formation 405, 407 corresponding to the mounting formation of the decking/joist supports. Each decking joist mounting formation includes the pair of shoulders 406, 408. Each decking joist mounting formation furthers include the pair of decking support abutment surfaces 410, 412.

As mentioned above, the multiple decking panels 220 as shown in FIGS. 16 to 19 may be attached to the structure. In certain embodiments, each decking panel may be any suitable decking panel known in the art. Each decking panel includes an abutment surface for abutting the decking panel abutment surface 420 of multiple decking joists 104. Each decking panel will be mounted to one or more of the decking joists using any suitable mounting means, such as using one or more fasteners, adhesives or a combination thereof. In certain embodiments, each decking panel is mounted substantially perpendicular to the decking joists.

The preferred method of installation of the decking system 100, including multiple base or joist clips 102, multiple decking joists 104 and multiple decking panels 220, will now be described.

In preferred embodiments, the method of installation includes the steps of: securing the base or joist clips 102 relative to a surface; mounting at least two decking joists 104, each to multiple base or joist clips; and, mounting the multiple decking panels to the at least two decking joists 104.

Referring to FIGS. 5 to 15 there is shown a joist support and joist assembly in a second mode of installation where it is used in conjunction with a height adjuster which is generally indicated at 500. The height adjuster 500 comprises a base part 510 and a carriage 550 which can be operatively mounted to the base part 510. The base part 510 includes a base body 512, a top 514 and a bottom 515 with an inclined ramp section 520 extending between opposed ends. The ramp section 520 is on the top 514 of the base body 515 and extends in a lengthwise direction between the opposed ends. The ramp section 520 is on the top 514 of the base body 515 and extends in a lengthwise direction between the opposed ends. The ramp section 520 is inclined with respect to the bottom 515 so that the distance between the ramp section 520 and the bottom 515 increases progressively from one end to the other. The bottom 515 of the base body 512 comprises a substantially flat planar surface. The base body 512 further includes an aperture 511 thereon which extends through the base body 512 from the top 514 to the bottom 515. The aperture 511 is adapted to receive a fastener for securing the base body 512 to an undersurface as will be described.

The carriage 550 includes a carriage body 551 having an upper joist mounting section 554 to which a joist support 102 can be mounted. The carriage 550 is adapted to be mounted to the base body 512 for movement along the ramp section 520.

Figure 8:
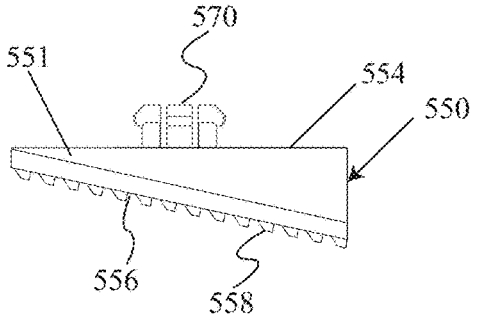
FIG. 8 is a side elevation of a component of a height adjuster according to one embodiment.
Figure 9:
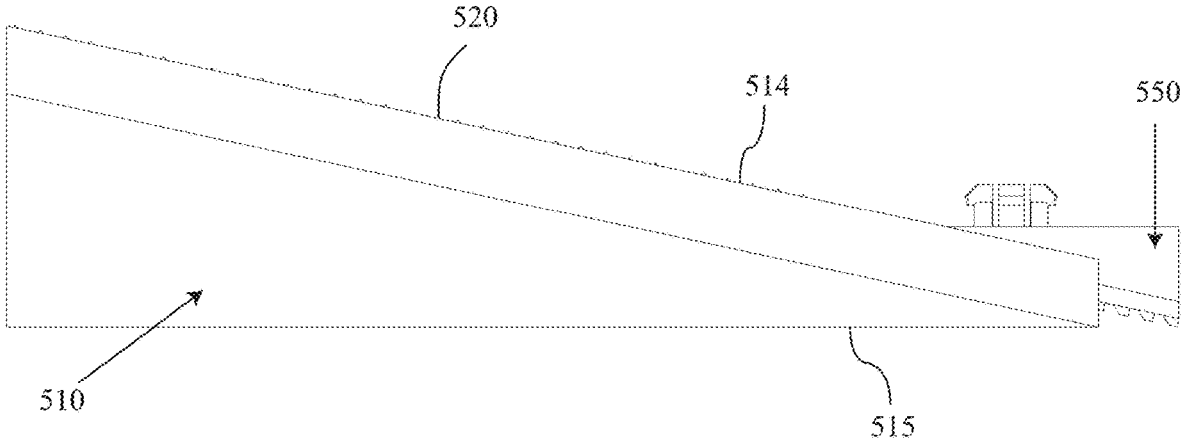
FIG. 9 is a side elevation of a height adjuster assembly according to one embodiment.
Figure 10:
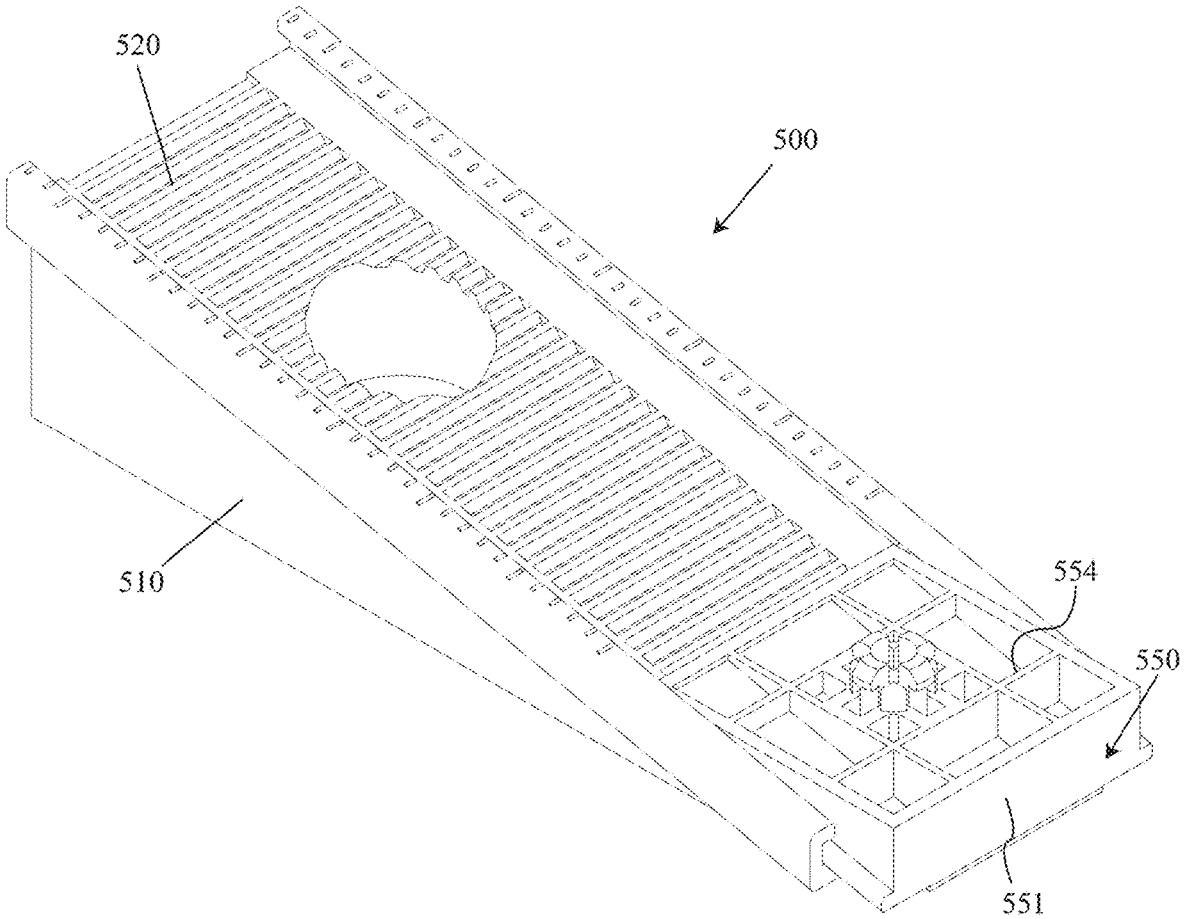
FIG. 10 is an isometric view of a height adjuster according to one embodiment.
Figure 11:
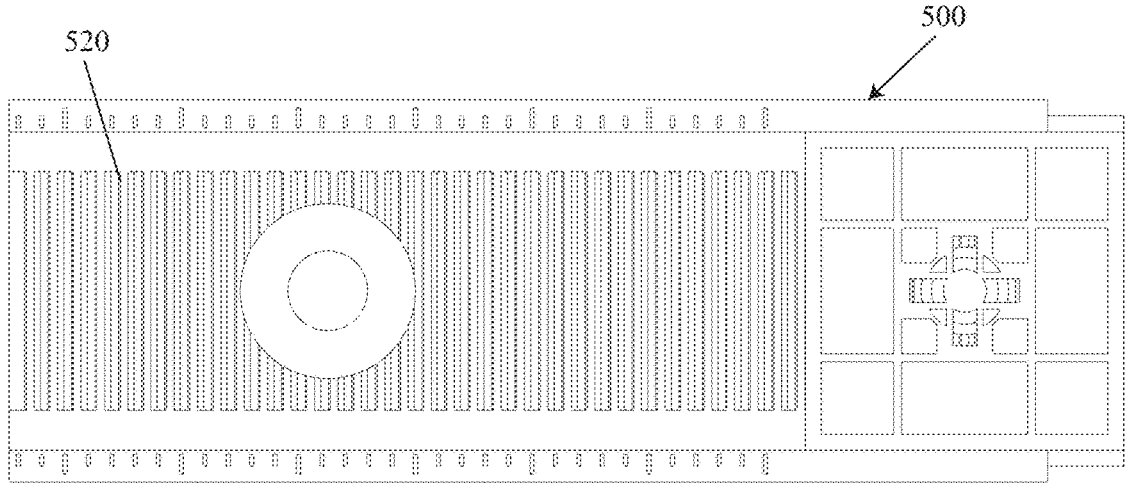
FIG. 11 is a plan view of the height adjuster shown in FIG. 10.
Figure 12:
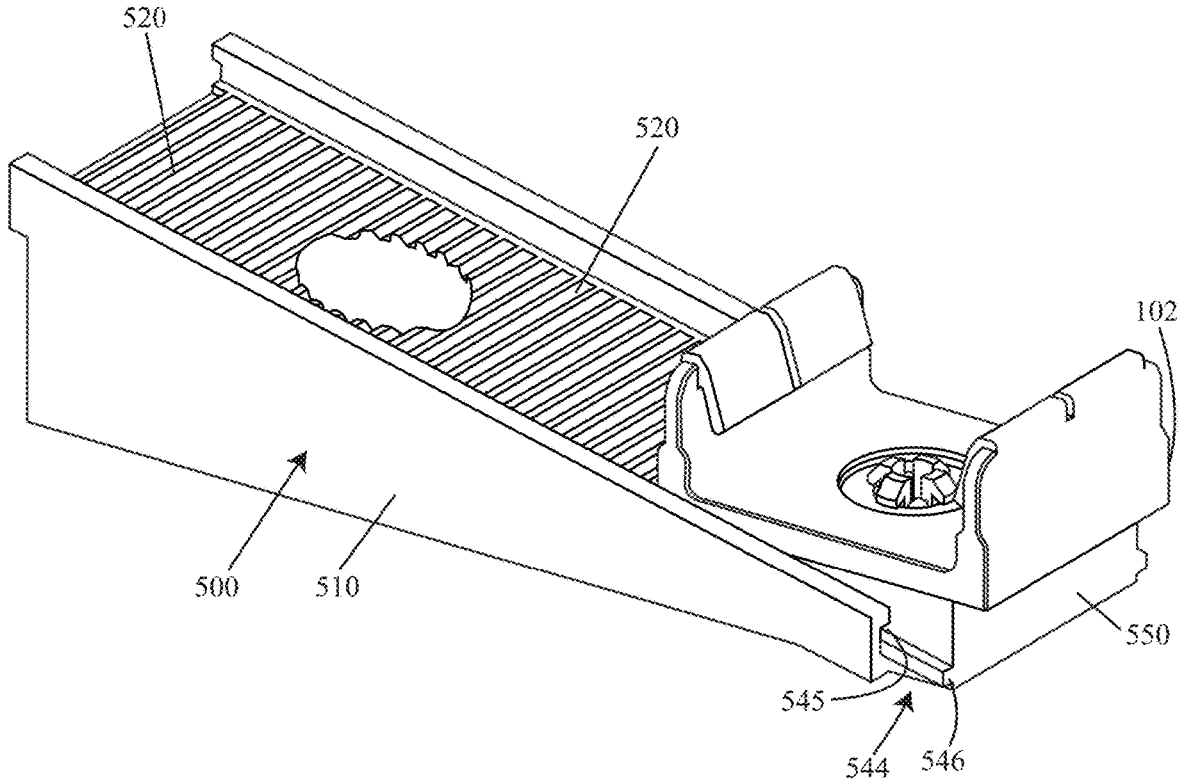
FIG. 12 is an isometric view of an adjuster according to an embodiment.
Figure 13:
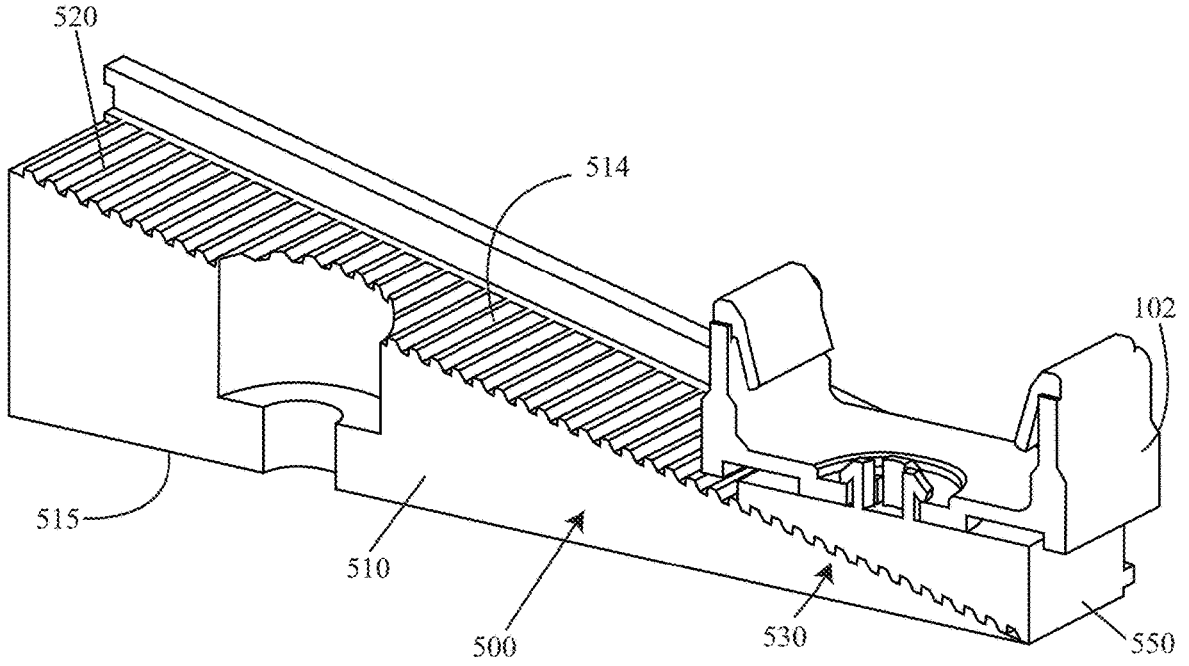
FIG. 13 is a sectional isometric view of the height adjuster shown in FIG. 12.

As shown in FIG. 8 the underside 556 of the carriage body 557 is inclined relative to the mounting section 554 which in use is disposed in a substantially level or horizontal plane. To this end the angle of inclination of the underside 556 is about the same as the angle of inclination of the ramp section 520.

Figure 14:
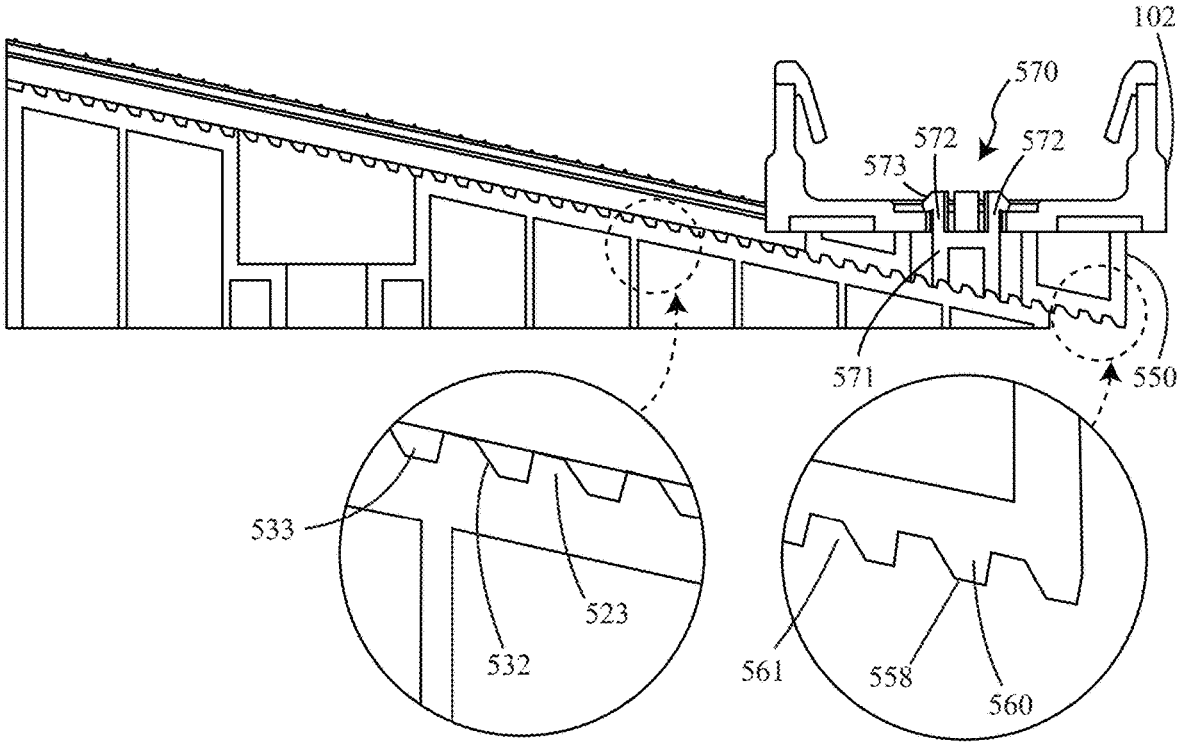
FIG. 14 is a sectional side elevation of the height adjuster shown in FIGS. 10 and 11 with enlarged views of parts thereof, including a joist support in a mounted position thereon.
Figure 15:
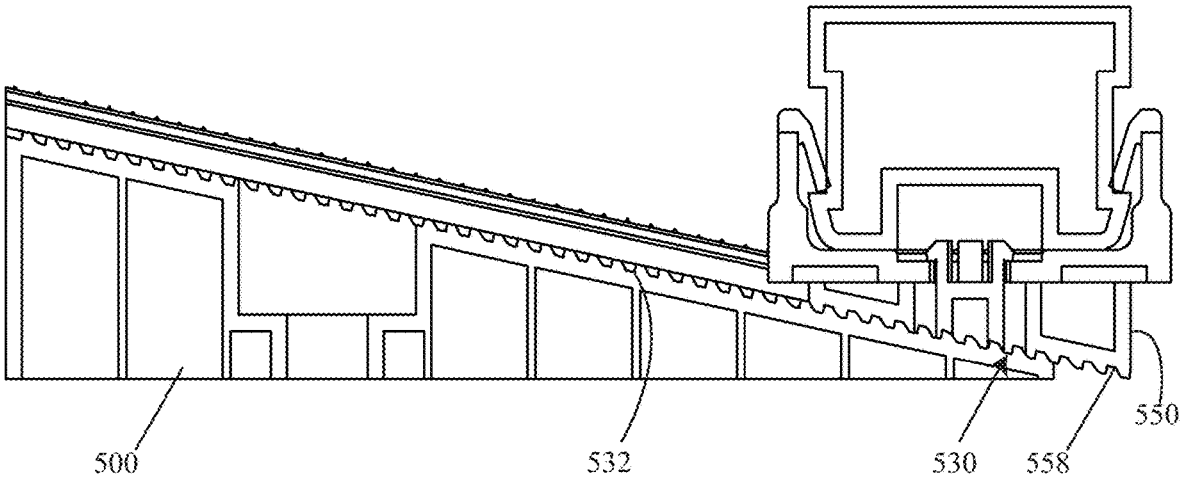
FIG. 15 is a similar view to that shown in FIG. 14 with the joist support and a joist thereon.

As shown in FIGS. 14 and 15, the base body 512 and carriage body 551 comprise an interlock arrangement 530 which enables the carriage 550 to be positioned along the ramp section 520 such that movement can be inhibited. As shown in FIGS. 14 and 15, the interlock arrangement 530 comprises spaced apart ramp formations 532 with spaces 533 therebetween on the ramp section 520 and cooperating carriage formations 558 on the underside 556 of the carriage body 551. The ramp formations 532 comprise spaced apart elongated ribs 523 extending laterally with respect to the lengthwise direction and cooperating spaced apart ribs 560 on the underside of the carriage body 554 with spaces 561 therebetween. The sets of ribs 523 and 560 are configured so as to interfit with one another to inhibit movement of the carriage along the ramp section when in an interfitted position. The ribs 532 are generally in a saw tooth configuration; that is the ribs are tooth like including a slow or less inclined linear inclination followed by a more rapid or steeper trailing inclination. This configuration enables the carriage to travel more easily in the lengthwise direction from the lower end of the ramp section to the upper end but is inhibited from travel in the opposite direction. To facilitate movement of the carriage in both directions it is adapted to be displaced laterally with respect to the ramp section so that the ribs are not in the interfitted position. In the interfitted position ribs 523 are disposed in spaces 561 and ribs 560 are disposed in spaces 533.

The height adjuster further includes a tracking guide arrangement 544 for guiding the movement of the carriage along the ramp section. As shown the tracking guide arrangement 544 comprises two slots 545 extending along each side of the base body 512 which are adapted to receive therein flanges 546 on opposite side of the carriage body 551. The slots 545 may be of greater height than the flanges 546 so that the carriage can be laterally displaced relative to the ramp section.

The carriage further includes a connector 570 by which a joist support 102 can be mounted to the carriage. The connector 570 comprises a post 571 which comprises a plurality of deformable segments 572 with a post head 573 at free ends of the segments 572. The post 571 is adapted to be received within aperture 308 in the joist support 102 so as to mount the support to the carriage.

Referencing again to FIGS. 16 to 19, there is illustrated a structure 100 comprising groups of joist support and joist assemblies arranged in an array on concrete slabs 210. Each group comprises two joists 400 arranged end to end in abutting relation with respect to one another, the joists being mounted to a number of joist supports 101 disposed in spaced apart relation along the length of the joists forming the group. One of the joist supports is in the region where the two joists in the group abut one another, thus providing support for the two joists in this region. The groups are disposed generally parallel to one another and the ends of the groups of joists may have end caps 225 fitted thereto. In the embodiment of FIGS. 16 and 17, the joist supports are secured directly to the concrete slab. In the embodiment of FIGS. 18 and 19, the supports are mounted to height adjusters 500, which in turn are mounted to directly to the concrete slab.

An advantage of the decking structure which is the subject of this disclosure is that is possible to provide a deck in which the deck panels or boards are at a relatively low height with respect to the undersurface. In some building constructions such as apartments and some housing the drop down from the door of the building to the patio areas is small. The undersurface may be a concrete slab which is often covered by tiles. In certain instances, there is an aesthetic desire to cover the area using decking panels. The decking structure of this disclosure facilitates this application of decking panels or boards.

A further advantage of the decking structure is that all of the components can be snap fitted together. That is the joist can be a snap fit engagement with the joist supports and, in the embodiment where a height adjuster is used, the joist support can be a snap fit to the mounting section of the height adjuster.

It is often the case that the concrete slab is slightly inclined for the purpose of drainage. It is however often desirable to have the decking panels or boards substantially level. The height adjuster facilitates this arrangement.

The structure and its associated components have been described with reference to its application to decks or decking. It will be appreciated that the structure could be used in other structural parts of a building. The joists may be in the form of elongated members for supporting parts of a building structure such as other types of flooring or ceiling.

In the forgoing description of preferred embodiments, specific terminology has been resorted to for the sake of clarity. However, the invention is not intended to be limited to specific terms so selected, and it is to be understood that each specific term includes all technical equivalents which operate in a similar manner to accomplish a similar technical purpose. Terms such as "front" and "rear", "inner" and "outer", "above", "below", "upper" and "lower" and the like are used as words of convenience to provide reference points and are not to be construed as limiting terms.

The reference in this specification to any prior publication (or information derived from it), or to any matter which is known, is not, and should not be taken as, an acknowledgement or admission or any form of suggestion that prior publication (or information derived from it) or known matter forms part of the common general knowledge in the field of endeavour to which this specification relates.

In this specification the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes only some embodiments of the invention(s), and alterations, modifications, addition and/or changes can be made thereto without departing from the scope and spirit of the disclosed embodiments, the embodiments being illustrative and not restrictive.

Furthermore, invention(s) have been describe in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention(s). Also, the various embodiments described above may be implemented in conjunction with other embodiments, e.g. aspects of one embodiment may be combined with aspects of another embodiment to realise yet other embodiments. Further, each independent feature or component of any given assembly may constitute an additional embodiment.

The reference numerals in the following claims do not in any way limit the scope of the respective claims.

TABLE OF PARTS

| | |
|---|---|
| Decking structure | 100 |
| Joist support | 101 |
| Joist clips | 102 |
| Support body | 300 |
| Base | 302 |
| Base wall | 304 |
| Abutment surface | 306 |
| Bottom side | 307 |
| Top side | 314 |
| Channel | 315 |
| Open ends | 317, 318 |
| Arms | 310, 312 |
| Support mounting formation | 313 |
| Flange member | 316 |
| Free end | 319 |
| Aperture | 308 |
| Joist | 104 |
| Elongated body | 400 |
| Ends | 411, 415 |

-continued

| TABLE OF PARTS | |
|---|---|
| Top wall | 420 |
| Bottom wall | 413 |
| Side walls | 401, 403 |
| Outer side | 416, 418 |
| Recess | 414 |
| Joist mounting formation | 405, 407 |
| Shoulders | 406, 408 |
| Recess | 402, 404 |
| Abutment surfaces | 410, 412 |
| Height adjuster | 500 |
| Base part | 510 |
| Base body | 512 |
| Bottom | 515 |
| Top | 514 |
| Ramp section | 520 |
| Interlock arrangement | 530 |
| Aperture | 511 |
| Ramp formations | 532 |
| Ribs | 523 |
| Spaces | 533 |
| Carriage | 550 |
| Carriage body | 551 |
| Underside | 556 |
| Joist support mounting section | 554 |
| Carriage formations | 558 |
| Ribs | 560 |
| Spaces | 561 |
| Tracking guide arrangement | 544 |
| Slot | 545 |
| Flange | 546 |
| Connector | 570 |
| Segments | 572 |
| Post | 571 |
| Head | 573 |
| Deck | 200 |
| Decking panels | 220 |
| Slab | 210 |

The invention claimed is:

1. A system for forming a decking substructure over an undersurface, the system comprising a plurality of joist supports, and joists adapted to be fitted thereto, wherein each joist support comprises a support body which includes a base wall having a bottom side, a top side and a mounting aperture therethrough from the bottom side to the top side, the support body further including two spaced apart side walls extending from the top side of the base wall such that the support body take the form of a channel with a substantially U-shaped cross section-having an open top and opposed spaced apart open ends, the channel when in use being configured so as to at least partially receive one of the joists therein, the bottom side of the base wall having a planar surface section which defines the outermost surface of the joist support, wherein each joist comprises an elongated body having opposed spaced apart ends, a top wall, a bottom wall spaced from the top wall and spaced apart side walls extending between the top and bottom walls, the bottom wall having an outer side that extends in from the side walls to a recess that extends up from the outer side, such that when fitted to one of the joist supports, the outer side lies adjacent to the top side of the base wall of the joist support and the recess overlies the mounting aperture in the base wall of the joist support to allow space for a head of a fastener or connector received through the mounting aperture, wherein each joist support further comprises a support mounting formation and each joist further comprises a joist mounting formation, the formations being adapted to cooperate and provide a snap fit type connection between the joist and the joist support, wherein the support mounting formation includes two substantially resilient deformable flange members each extending inwardly from a respective joint support side wall towards the joist support base wall and terminating at a free end, and wherein the joist mounting formation includes a side recess in each joist side wall, each side recess having a lower edge which provides for a shoulder, the free ends of the flange members engaging against the shoulders when joist and joist support are fitted together, and wherein each joist support is operable in a first and second mode of installation, wherein in the first mode of installation the planar surface section operates as an abutment surface for seating of the joist support directly on the undersurface, and, in the second mode of installation, the joist support is releasably mounted to a height adjuster by way of the mounting aperture in the base wall.

2. The system according to claim 1, further comprising one or more height adjusters for use with the joist supports when in the second mode of installation, each height adjuster comprising a base part and a carriage, the base part including a top, a bottom, and opposed ends, the bottom of the base part being configured to be seated on the undersurface, the top of the base part including an inclined ramp section extending between the ends of the base part, the ramp section being adjacent the bottom of the base part at one of the ends, and the distance between the ramp section and the bottom of the base part progressively increasing towards the other end, the ramp section providing a pathway along which the carriage can travel to be located at different heights from the bottom, each height adjuster further including an interlock arrangement for enabling the carriage to be held in any one of a number of positions along the ramp section.

3. The system according to claim 2, wherein the carriage includes a carriage body having an underside which in use is disposed adjacent the ramp section, the carriage body further including an upper joist support mounting section.

4. The system according to claim 3, wherein the underside of the carriage is inclined relative to the bottom of the base part so that the joist support mounting section maintains the joist support in a substantially level orientation when mounted thereto.

5. The system according to claim 2, wherein the interlock arrangement includes a plurality of spaced apart ramp formations on the ramp section and one or more cooperating carriage formations on the carriage which are configured to hold the carriage in a selected position on the ramp section.

6. The system according to claim 5, wherein the ramp formations include a plurality of spaced apart elongated ribs spaced apart along the ramp section, the ribs extending laterally with respect to a direction from one end of the base part to the other end thereof, substantially the entire distance between sides of the ramp section, and wherein the carriage formations include one or more ribs on the underside of the carriage body which are arranged to be able to interfit with the ramp ribs so as to inhibit movement of the carriage along the ramp section when in an interfitted position.

7. The system according to claim 2, further comprising a tracking guide arrangement guiding the movement of the carriage along the ramp section.

8. The system according to claim 7, wherein the tracking guide arrangement includes a cooperating flange and slot on the base part and carriage, one of either the flange or slot being on the base part and extending along the ramp portion between ends of the base part, the other of the flange or slot being on the carriage, the flange being received within the slot so as to guide the movement of the carriage along the ramp section.

9. The system according to claim 2, wherein each height adjuster carriage further comprises a connector for releasably connecting the joist support to the carriage.

10. The system according to claim 9, wherein the connector includes a post including a plurality of deformable segments having free ends which together form a post head, the post being receivable in the mounting aperture in the base wall of the joist support to provide for a snap fit type connection.

11. The system according to claim 2, wherein the base part of the height adjuster includes a securement aperture therethrough, from the top to the bottom of the base part, the securement aperture adapted to receive a fastener for securement of the height adjuster to the undersurface.

12. The system according to claim 1, wherein the base wall of the joist support is of substantially constant thickness from the top side thereof to the planar surface section.

13. The system according to claim 1, wherein the deformable flanges extend from an upper end of respective ones of the side walls.

14. A decking substructure formed using a system as claimed in claim 1, the decking substructure comprising a first group of joist supports and joists as defined in claim 1 installed directly on the undersurface, and a second group of joist supports and joists as defined in claim 1 installed on height adjusters.

15. A decking substructure formed using a system as claimed in claim 2, the decking substructure comprising a first group of joist supports and joists as defined in claim 2 installed directly on the undersurface, and a second group of joist supports and joists installed on height adjusters as defined in claim 2.

* * * * *